US006231492B1

(12) United States Patent
Graag

(10) Patent No.: US 6,231,492 B1
(45) **Date of Patent: *May 15, 2001**

(54) CUTTING DRUM HAVING CIRCUMFERENTIALLY ADJUSTABLE CUTTING BLADES FOR USE ON A ROTARY PRESS FOLDING MACHINE

(75) Inventor: David N. Graag, Westmont, IL (US)

(73) Assignee: Goss Graphic Systems Inc., Westmont, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/075,774

(22) Filed: May 11, 1998

(51) Int. Cl.[7] ..... B31F 7/00; B26D 1/24; B26D 5/08

(52) U.S. Cl. ..... 493/368; 83/543; 83/497

(58) Field of Search ..... 493/368, 32, 33; 83/496, 497, 344, 543

(56) References Cited

U.S. PATENT DOCUMENTS

| | | |
|---|---|---|
| 4,003,300 | 1/1977 | Grobman . |
| 4,190,242 | 2/1980 | Bolza-Schunemann . |
| 4,295,843 | 10/1981 | Otomaru . |
| 4,564,183 | 1/1986 | Muller . |
| 4,690,022 | 9/1987 | Takahashi . |
| 5,017,184 | 5/1991 | Takahori et al. . |
| 5,181,899 | 1/1993 | Hill et al. . |
| 5,316,538 | 5/1994 | Hill et al. . |
| 5,344,377 | 9/1994 | Meeks . |
| 5,527,256 | 6/1996 | Vauchelle et al. . |
| 5,565,057 | 10/1996 | Owens . |

*Primary Examiner*—Brian L. Johnson
*Assistant Examiner*—Matthew Luby
(74) *Attorney, Agent, or Firm*—Marshall, O'Toole, Gerstein, Murray & Borun

(57) ABSTRACT

An adjustable cutting bar having a pair of cutting blades for use on a rotary press folding machine includes a rotatable shaft supported on a frame, a first cutting blade secured to the shaft for common rotation therewith, and a second cutting blade rotatably mounted to the shaft to permit circumferential rotation of the second cutting blade relative to the first cutting blade. A drive system is operatively connected to the first and second cutting blades for rotating the first and second cutting blades at a common peripheral speed.

30 Claims, 3 Drawing Sheets

CUTTING DRUM HAVING CIRCUMFERENTIALLY ADJUSTABLE CUTTING BLADES FOR USE ON A ROTARY PRESS FOLDING MACHINE

FIELD OF THE INVENTION

The present invention relates to a cutting bar for use on a rotary press folding machine. More specifically, the present invention relates to a cutting bar having a pair of adjustable cutting blades for cutting a paper web into equal or unequal cut lengths.

BACKGROUND OF THE INVENTION

On rotary press folding machines, a generally cylindrical cutting drum having a pair of cutting blades is positioned adjacent to a folding drum. The blades of the cutting drum cut a web of paper having an image imprinted thereon into sections of a predetermined length, which are then folded by the folding drum in a manner well known in the art.

Preferably, the cutting drum blades are adjustable, making it possible to run the folding machine in both "straight" and "collect" modes. When the press is operated in "straight" mode, the cutting drum blades are oppositely disposed on the cutting drum. Thus, the drum cuts two paper sections of equal length per revolution. The sections have an identical image, making a continuous run possible. By comparison, when operating in "collect" mode, one of the cutting drum blades is moved circumferentially, enabling the cutting drum to cut one longer section and one shorter section per revolution. The sections, having different images imprinted thereon, are then collected before folding, thus precluding a continuous run.

A variety of devices have been employed in order to provide for the adjustment of the cutting blades. One such approach is to adjust the position of the blades using one or more spacers. The position of the blade is then fixed using a wedge to lock the blade in place. Unfortunately, in order to i adjust the position of the blades, the press must be stopped, and the wedges and spacers must be extracted and re-installed. Such a system is labor intensive and time consuming, and does not permit stepless adjustment of the cutting blades.

Another prior art device is disclosed in U.S. Pat. No. 5,017,184 issued to Takahori et al. The Takahori device uses an outer cylinder having a first cutting blade and an inner cylinder housed within and rotatable relative to the outer cylinder and having a second cutting blade which protrudes from a gap in the outer cylinder. Unfortunately, in addition to other shortcomings the range of adjustability is limited due to the inner/outer cylinder construction.

Accordingly, there exists a need for an improved cutting bar for use with a rotary press folding machine.

SUMMARY OF THE INVENTION

An improved adjustable cutting bar according to the present invention has adjustable blades that are moveable so as to be circumferentially adjustable relative to each other in order to permit the cutting of paper sections of the same or different lengths. The cutting drum of the present invention enables the relative position of the cutting blades to be adjusted quickly with a minimum of down time and/or labor, and enables the blades to be adjusted in a stepless fashion. Moreover, the present construction permits the cutting blades to be adjusted through a very wide range.

According to one aspect of the present invention, an adjustable cutting bar for a rotary press folding machine includes a rotatable shaft supported on a frame and a first cutting blade mounted to the shaft for common rotation with the shaft. A second cutting blade is rotatably mounted to the shaft, so as to permit circumferential movement of the second cutting blade relative to the first cutting blade about the axis of the shaft. A drive system rotates both of the cutting blades about the axis of the shaft at a common peripheral speed.

In further accordance with the preferred embodiment, each of the cutting blades is mounted to a carrier bar, and each of the carrier bars in turn is mounted between a pair of end brackets. Preferably, the end brackets include a seat for receiving the end of the carrier bar, and each of the carrier bar ends are secured to the end brackets by fasteners oriented generally parallel to the axis of the rotatable shaft.

The drive system includes a drive shaft having a pair of drive gears. One of the drive gears engages a driven gear carried by the rotatable shaft for rotating the first cutting blade, and a second drive gear engages a driven gear connected to the second cutting blade. At least one of the drive/driven gear arrangements includes helical gears, so that upon axial movement of the drive shaft the helical driven gear is rotated, thus rotating the attached cutting blade relative to the other cutting blade. The first and second drive/driven gear combinations may both be provided with helical gears with opposite flighting, thus permitting both of the cutting blades to be adjusted circumferentially simultaneously, in opposite peripheral directions, upon axial adjustment of the drive shaft. One of the drive gears is preferably mounted to a drive hub by a clutch assembly, which permits the driven gear to rotate relative to the drive hub in the event the folding machine encounters a jam, thereby avoiding potential damage to the drive system. Finally, the position of one of the driven gears can be adjusted relative to the drive hub using a backlash adjustment mechanism, which improves performance by eliminating play in the drive system.

In accordance with another aspect of the invention, an adjustable cutting drum for a rotary press folding machine includes a rotatable shaft having a fixed cutting blade mounted to the shaft for common rotation with the shaft. An adjustable cutting blade is rotatably mounted to the shaft in order to permit rotation of the adjustable cutting blade about the shaft, which adjusts the relative peripheral position of the cutting blades relative to each other. An adjustable drive system engages the cutting blades for rotating the blades at a common peripheral speed. The adjustable drive system further permits the position of the cutting blades relative to each other to be changed.

In accordance with yet another aspect of the invention, an adjustable cutting drum for use with a rotary press folding machine includes a rotatable shaft supported on a frame, and a first cutting blade secured to the shaft for common rotation with the rotatable shaft. A second cutting blade is secured by mounting means to the shaft to permit circumferential rotation of the second cutting blade about the axis of the rotatable shaft, thereby permitting adjustment of the relative circumferential positions of the cutting blades. Adjustable drive means are provided which operatively engages the first and second cutting blades for rotating the first and second cutting blades at a common peripheral speed, and further for adjusting the position of the second cutting blade relative to the first cutting blade.

In accordance with a still further aspect of the present invention, an adjustable cutting drum for use with a rotary press folding machine comprises a rotatable shaft supported on a frame and a first cutting blade secured to the shaft for common rotation therewith. A second cutting blade is mounted by mounting means to the shaft to permit circumferential rotation of the second cutting blade about the axis of the rotatable shaft, thereby permitting adjustment of the relative circumferential positions of the cutting blades. Drive means operatively connect the first and second cutting blades for rotating the first and second cutting blades at a common peripheral speed, and adjustment means permit adjusting the circumferential position of the second cutting blade relative to the first cutting blade.

An improved cutting drum incorporating the features of the present invention will enable stepless adjustment of the cutting blades permitting the folding machine to operate in either straight or collect modes, and changeover time between modes is effectively eliminated. Further objects, features and advantages of the present invention will become readily apparent to those skilled in the art upon a reading of the following detailed description.

DETAILED DESCRIPTION OF THE INVENTION

Figure 1:
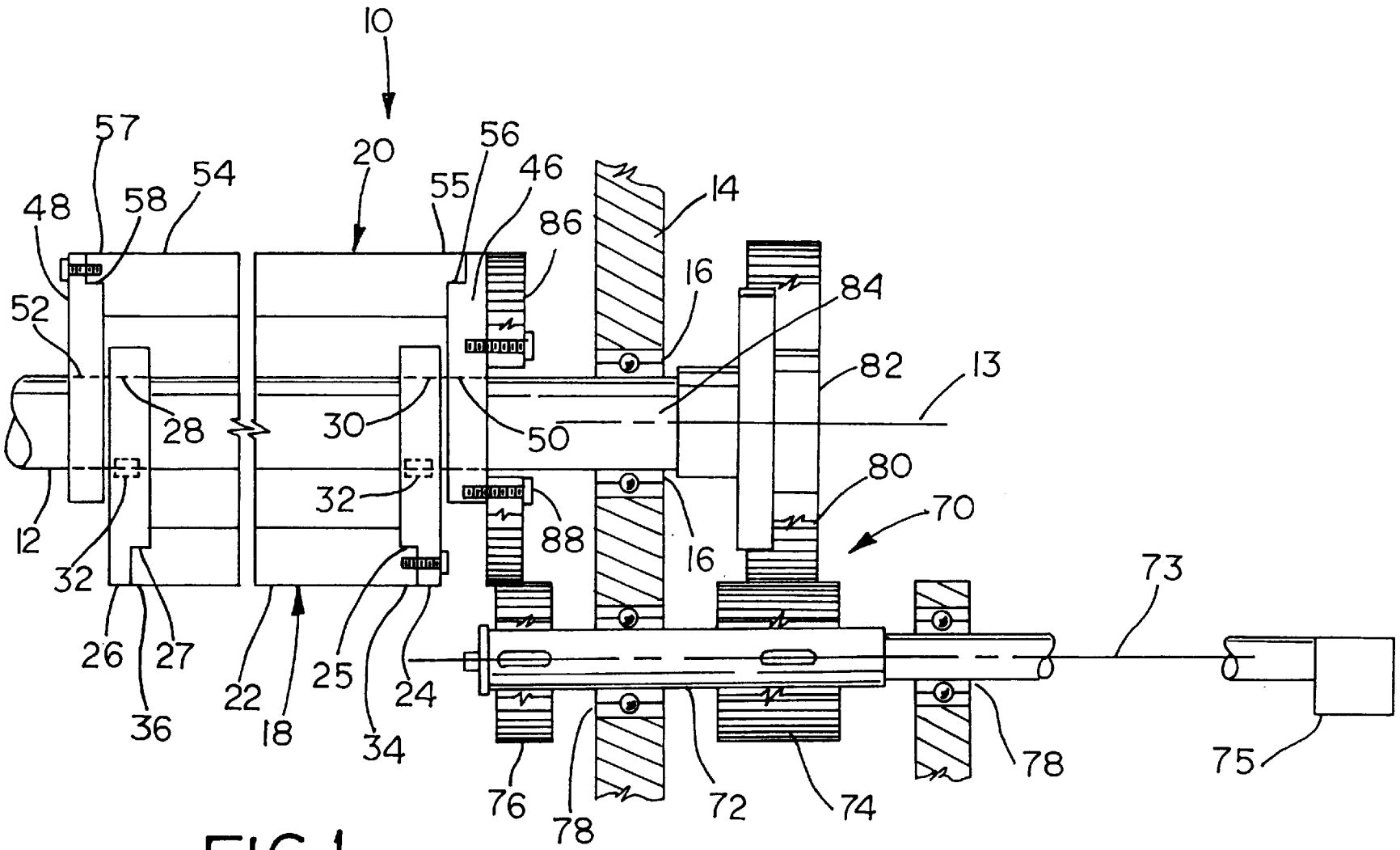
FIG. 1 is a fragmentary elevational view, partly in section, of an adjustable cutting bar apparatus incorporating the features of the present invention.

The embodiment described herein is not intended to be exhaustive or to limit the scope of the invention to the precise form disclosed. The following embodiment has been chosen in order to best explain the principles of the invention and its practical use so that others skilled in the pertinent art may follow its teachings.

Referring now to the drawings, an adjustable cutting bar or drum assembled according to the teachings of the present invention is generally referred to by the reference numeral 10. Preferably, the cutting drum 10 is adapted for use on a rotary press folding machine (not shown). Cutting drum 10 includes a shaft 12 which is rotatably supported on frame 14 by a plurality of bearings 16 as is well known in the art. First and second cutting blade assemblies 18, 20, respectively, are mounted to the rotatable shaft 12. A drive system 70 is provided for rotating the cutting drum 10 about the axis 13 of shaft 12 as will be explained in greater detail below.

Figure 2:
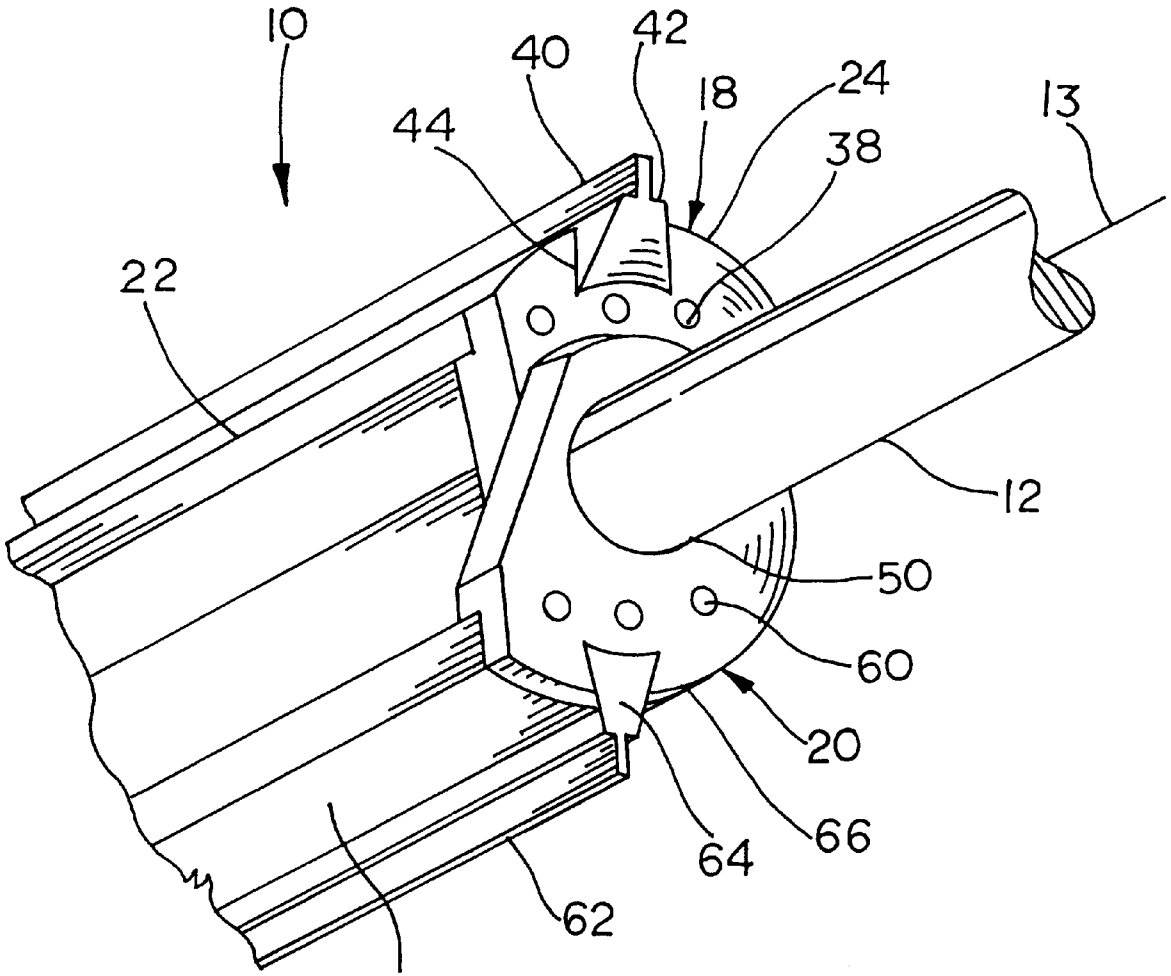
FIG. 2 is an enlarged fragmentary view in perspective of a portion of the present cutting bar device illustrating the carrier bars, the end brackets, and a portion of the rotatable shaft.

As shown in FIGS. 1 and 2, first cutting blade assembly 18 includes a carrier bar 22 supported between a pair of end brackets 24, 26. End brackets 24, 26 each include a bore 28, 30, respectively, to permit end brackets 24, 26 to slide onto shaft 12. Each end bracket 24, 26 also includes a key 32 so that the end brackets 24, 26 and the attached cutting blade assembly 18 rotate in common with shaft 12. Alternatively, the shaft 12 may include a spline or any other suitable connection. Each end bracket 24, 26 also includes a notch or seat 25, 27, respectively, which receive the adjacent ends 34, 36 of carrier bar 22. A plurality of bolts or other suitable fasteners 38 secure the ends 34, 36 of carrier bar 22 to their respective end brackets 24, 26. A cutting blade 40 is secured within a knife box 42 or other suitable fastener, which is secured within a longitudinal notch 44 extending along the carrier bar 22 and extending through the end brackets 24, 26.

Second cutting blade assembly 20 includes a pair of end brackets 46, 48, each of which includes a bore 50, 52 sized to rotatably receive the shaft 12 so that the end brackets 46, 48 are rotatable relative to shaft 12 about the central axis 13 of shaft 12. A carrier bar 54 extends between end brackets 46, 48. End brackets 46, 48 include a notch or seat 56, 58, respectively, which receive the adjacent ends 55, 57 of carrier bar 54. A plurality of bolts or other suitable fasteners 60 secure the ends 55, 57 to their adjacent end bracket 46, 48. A cutting blade 62 is secured within a knife box 64 or other suitable fastener, which is secured within a longitudinal notch 66 extending along the carrier bar 54 and extending through the end brackets 46, 48.

Referring now to FIG. 1, drive system 70 includes a sidelay drive shaft 72 with a pair of drive gears 74, 76. Drive shaft 72 is rotatably supported within frame 14 by a plurality of bearings 78 so as to permit axial movement of drive shaft 72. An actuator 75, such as a pneumatic cylinder, a hydraulic cylinder, or a mechanical actuator, is provided to impart axial movement to drive shaft 72. Drive system 70 includes a driven gear 80 which is mounted by a clutch assembly 71 to a hub 82 secured to a drive end 84 of rotatable shaft 12. Drive gear 74 meshes with driven gear 80 as will be discussed in greater detail below. A second driven gear 86 is secured to the end bracket 46 of the second cutting blade assembly 20 by a plurality of fasteners 88, so that the driven gear 86 and the second cutting blade assembly 20 are rotatable about the axis 13 of shaft 12. Drive gear 76 meshes with the driven gear 86 as will be discussed in further detail below.

Also as shown in FIG. 1, the outer diameters of drive gears 74, 76 are identical, as are the outer diameters of driven gears 80, 86, so that upon rotation of drive shaft 72 the driven gears 80, 86 rotate at a common peripheral speed. As a result, the first and second cutting blades 18, 20 also rotate at a common peripheral speed about the axis 13 of rotatable shaft 12. As stated above, a portion of drive shaft 72 is adapted for axial movement along the longitudinal axis 73 of drive shaft 72. Accordingly, the drive gear 74 is movable relative to the driven gear 80. As outlined above, by virtue of the helical flighting on gears 74, 80, the axial movement of drive gear 74 causes the driven gear 80 to rotate about the axis 13 of rotatable shaft 12. In the process, by virtue of the straight gearing on drive gear 76 and driven gear 86, the position of cutting bar assembly 20 with respect to a fixed reference point such as frame 14 is maintained. Accordingly, the position of first cutting blade assembly 18 relative to second cutting blade assembly 20 is changed.

In operation, when it is desired to run a rotary press folding machine (not shown) in straight mode, the cutting blade assemblies 18, 20 are positioned substantially as shown in FIG. 2 with the cutting blades 40, 62, respectively oriented 180° apart.

Figure 4:
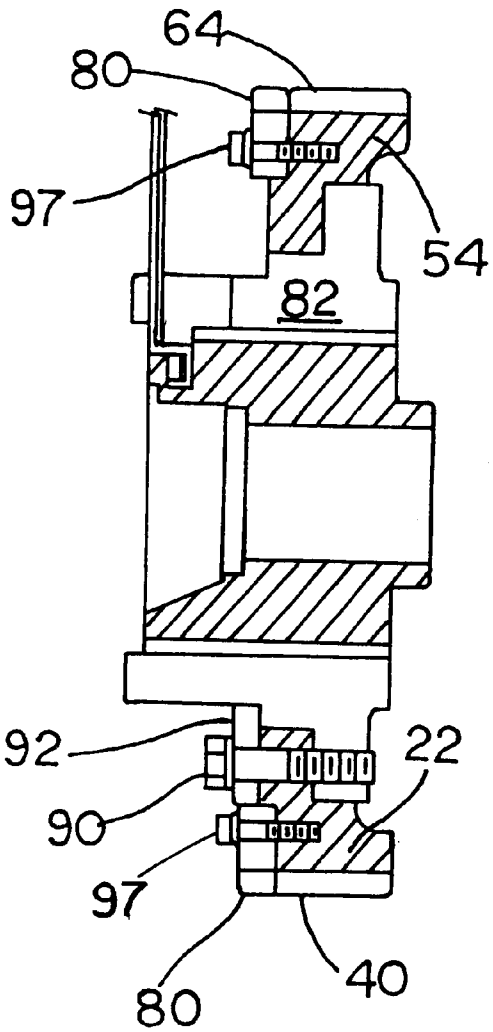
FIG. 4 is a fragmentary cross-sectional view taken along lines 4—4 of FIG. 3.
Figure 3:
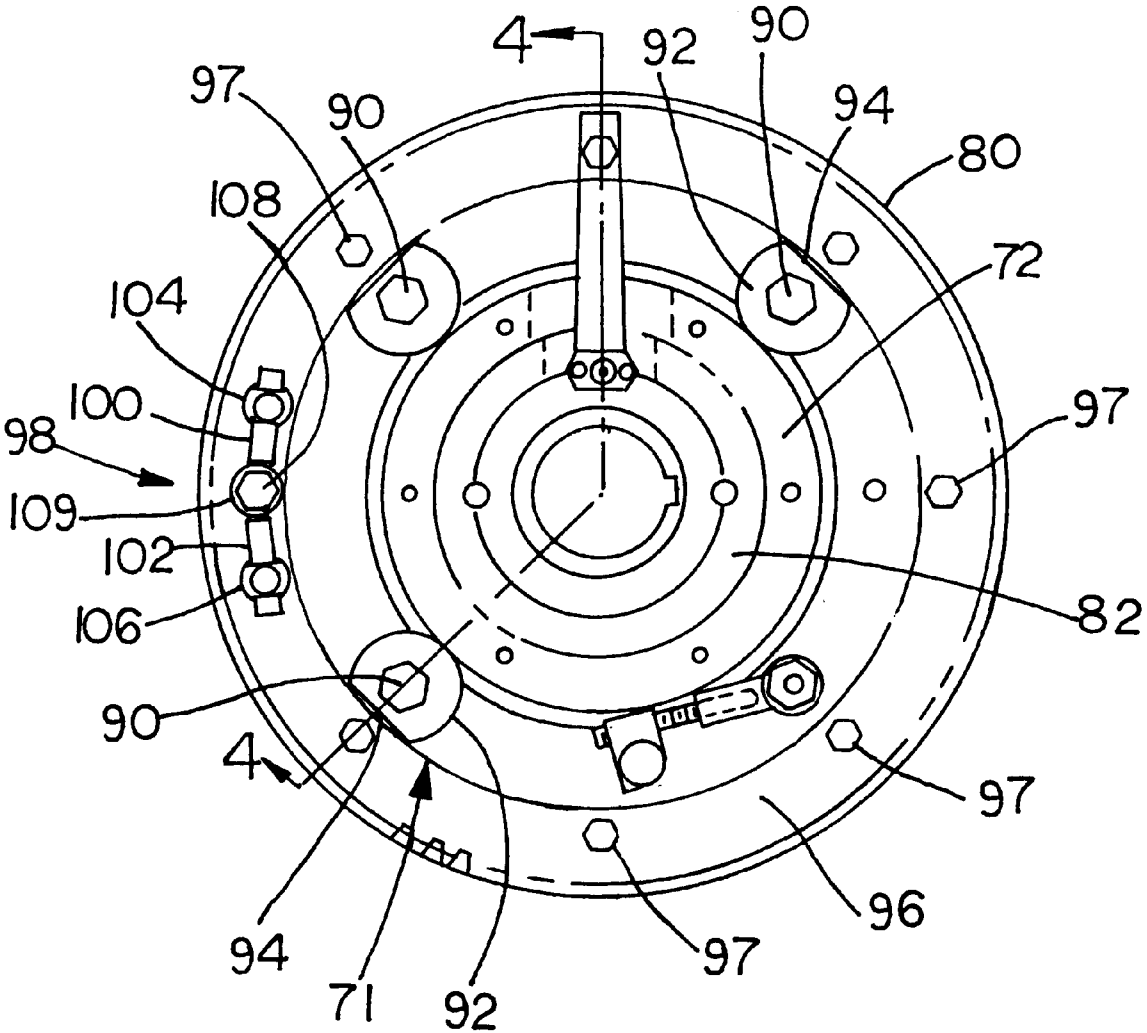
FIG. 3 is an enlarged elevational view of the connection between one of the driven gears and the rotatable shaft illustrating the backlash adjustment mechanism and the clutch mechanism.

Referring now to FIGS. 3 and 4, clutch assembly 71 includes a plurality of bolts 90 threaded into hub 82. Each bolt 90 includes a truncated flat washer 92, which is preferably brass. Each flat washer 92 includes an outwardly facing edge 94, which engages an inner ring 96 on gear 80. The gear 80 is removably attached to the inner ring 96 by a plurality of bolts 97. The edges 94 of flat washers 92 frictionally engage the inner ring 96, so that in the event of a jam or other malfunction, the clutch assembly 71 allows gear 80 to spin relative to the hub 82 and shaft 12. The clutch 71 can be re-set by re-torquing the bolts 90.

A backlash adjuster 98 adjustably secures the inner ring 96 and hence the driven gear 80 to the hub 82. Adjuster 98 includes a pair of opposed threaded adjustment screws 100, 102, each of which is threaded through a block 104, 106, respectively. Blocks 104, 106 are mounted to the inner ring 96. The end of each adjustment screw 100, 102 contacts a lug 108 on hub 82. Lug 108 protrudes through an opening 109 in the inner ring, and is preferably a removable bolt so that the inner ring 96 and the driven gear 80 may be removed from hub 82. Accordingly, the position of the inner ring 96 and its attached driven gear 80, can be changed by, for example, advancing adjustment screw 100 and retracting adjustment screw 102. The force of either of the adjustment screws 100, 102 bearing against the lug 108 will cause the inner ring 96 to rotate relative to the hub 82. Accordingly, drive system backlash, which normally runs in the range of 0.006–0.008 inches, can be reduced to approximately 0.002–0.003 inches. In practice, the backlash adjuster 98 extends the service life of the knife boxes 42, 64, as well as the cutting rubbers contained therein (not shown), each of which resiliently supports a knife blade 40, 62, respectively. Upon rotation of the cutting drum 10, each blade 40, 62 contacts a cutting strip (not shown) on an adjacent rotating drum or cylinder (not shown) as is well known in the art. Less gear backlash reduces movement of the blades 40, 62 within their knife boxes 42, 62, resulting in less gouging of the cutting strip (not shown), improved cutting performance, and improved service life for the various components.

In operation, when the rotary press folding machine (not shown) is operated in straight mode, the cutting blades 42, 64 are positioned 180° apart by adjusting the axial position of drive shaft 72 using actuator 75. This can be accomplished while shaft 72 is rotating about its axis 73 or while the shaft 72 is stationary. With the blades 42, 64 so positioned, the cutting drum 10 is rotated by drive system 70. Helical drive gear 74 meshes with gear 80, and drive gear 76 meshes with gear 86, so that blades 40, 62 rotate about the axis 13 of shaft 12 at a common peripheral or circumferential speed. As is evident from the foregoing, the first cutting blade assembly 18 rotates about the axis 13 by virtue of its connection to shaft 12, while the second cutting blade assembly 20 rotates about the axis 13 by virtue of drive gear 76 driving the driven gear 86. In the process, the cutting blades 42, 64 are brought into contact with cutting strips (not shown) on an adjacent roller (not shown) as is well known in the art in order to cut a paper web (not shown) into sections of substantially equal lengths.

When it is desired to operate the rotary press folding machine in collect mode, the position of the blades 42, 64 must be changed so that they are no longer 180° apart, so that the cutting drum 10 can cut paper sections (not shown) of longer or shorter lengths than those cut when operating in straight mode. In order to move the blades 42, 64 relative to each other, actuator 75 is used to axially advance or retract (depending on the desired adjustment) drive shaft 72. When drive shaft 72 moves axially, gears 74 and 76 also move. By virtue of the helical gearing on gears 74 and 80, gear 80, hub 82, and hence shaft 12 and its attached cutting blade assembly 18 rotate about the axis 13 of shaft 12. By virtue of the non-helical gearing on gears 76 and 86, cutting blade assembly 20 and the end brackets 46, 48 do not rotate about the axis 13 of the shaft 12. Accordingly, the relative position of the cutting blade assemblies 18, 20 is changed. The end result is the same if drive shaft 72 is moved axially while the drive shaft 72 is rotating. Alternatively, all of the gears 74, 76, 80, 86 may be helical, with gears 74, 80 having flighting that is opposite of the flighting on gears 76, 86.

As outlined above, if the folding machine (not shown) encounters a paper jam, the clutch assembly 71 permits the gear 80 to rotate relative the shaft 12, which may stop abruptly in a jam. Accordingly, damage to the drive system 70 is avoided.

The foregoing detailed description is merely illustrative of the invention and is not intended to limit the scope of the invention to the precise form disclosed. It is contemplated that certain variations are possible without departing from the scope of the following claims.

What is claimed is:

1. An adjustable cutting bar for use on a rotary press folding machine, comprising:

a one-piece rotatable shaft supported on a frame;

a first cutting blade secured to a first carrier bar assembly, the first carrier bar assembly being mounted to the shaft by a first pair of end brackets encircling the shaft, the first pair of end brackets being keyed to the shaft for common rotation therewith;

a second cutting blade secured to a second carrier bar assembly, the second carrier bar assembly being rotatably mounted to the shaft by a second pair of end brackets encircling the shaft, the second pair of end brackets rotatable about a circumference of the shaft to thereby permit rotational adjustment of the second carrier bar assembly about an axis of the shaft in a circumferential direction, thereby permitting the circumferential position of the second cutting blade relative to the first cutting blade to be adjusted; and a drive system operatively connected to the first and second carrier bar assemblies for rotating the first and second carrier bar assemblies and their attached cutting blades at a common peripheral speed, the drive system including an axially moveable drive shaft, the circumferential position of the first carrier bar assembly and its attached cutting blade being adjusted relative to the second carrier bar assembly and its attached cutting blade in response to axial movement of the drive shaft.

2. The cutting bar of claim 1, wherein the drive system is connected to the shaft and the second carrier bar assembly.

3. The cutting bar of claim 1, wherein the first carrier bar assembly includes a carrier bar mounted between the first pair of end brackets and wherein the second carrier bar assembly includes a carrier bar mounted between the second pair of end brackets.

4. The cutting bar of claim 3, wherein each of the end brackets includes a seat, the carrier ends of each carrier bar being secured to their corresponding end bracket seats by a plurality of fasteners oriented generally parallel to the axis of the shaft.

5. The cutting bar of claim 1, wherein the drive system includes a drive shaft having first and second drive gears, and including a first driven gear connected to the shaft and engaging the first drive gear, and further including a second driven gear connected to the second carrier bar assembly and engaging the second drive gear.

6. The cutting bar of claim 5, wherein the drive shaft is axially moveable and further wherein the first drive gear and the first driven gear are helical gears, so that upon axial movement of the drive shaft the position of the first driven gear relative to the second driven gear is changed.

7. The cutting bar of claim 5, wherein the drive shaft is axially moveable and further wherein the first drive and driven gears are helical gears, and the second drive and driven gears are helical gears pitched oppositely than the first drive and driven gears, so that upon axial movement of the drive shaft the first and second carrier bar assemblies are moved in opposite peripheral directions.

8. The cutting bar of claim 1, wherein each of the carrier bar assemblies includes an arcuate outer surface.

9. The cutting bar of claim 5, the second driven gear is mounted to one of the end brackets and the second drive gear engages the second driven gear.

10. The cutting bar of claim 1, wherein the drive system includes a clutch assembly.

11. The cutting bar of claim 5, wherein the drive shaft includes a drive hub, and the first driven gear is attached to the drive hub by a clutch.

12. The cutting bar of claim 5, wherein the drive shaft includes a drive hub, and the first driven gear is adjustably mounted to the drive hub.

13. The cutting bar of claim 5, wherein the drive shaft includes a drive hub, and backlash adjustment means for adjustably mounting the first driven gear to the drive hub.

14. An adjustable cutting drum for a rotary press folding machine, comprising:

a continuous one-piece shaft mounted for rotation on a frame, the shaft including an axis;

a fixed cutting blade connected to the shaft for common rotation therewith;

an adjustable cutting blade mounted to the shaft by a pair of end brackets, each of the end brackets having a bore sized to receive therein the shaft so that the brackets and the adjustable cutting blade are adjustable about the shaft axis along an arcuate circumferential path, thereby permitting the relative circumferential position of the adjustable cutting blade and the fixed cutting blade to be adjusted, the fixed cutting blade and the adjustable cutting blade being mounted to the shaft independently of each other;

an adjustable drive system having a first portion engaging the fixed cutting blade and further having a second portion engaging the adjustable cutting blade, the adjustable drive system being adapted to rotate the fixed cutting blade and the adjustable cutting blade about the shaft axis at a common peripheral speed, at least one of the drive system portions further being moveable to thereby permit the circumferential position of the adjustable cutting blade relative to the fixed cutting blade to be adjusted in response to movement of the at least one drive system portion.

15. The cutting drum of claim 14, wherein each of the cutting blades is mounted to a carrier bar.

16. The cutting drum of claim 15, wherein each of the carrier bars is mounted between a pair of end brackets.

17. The cutting drum of claim 16, wherein each carrier bar includes a pair of ends and wherein each of the end brackets includes a seat, each carrier bar end being secured to the seat of an adjacent end bracket by a plurality of fasteners oriented generally parallel to the axis of the shaft.

18. The cutting drum of claim 14, wherein the second cutting blade is mounted to a carrier bar having a pair of ends, each of the ends being mounted to an end bracket rotatably mounted to the shaft.

19. The cutting drum of claim 18, wherein each of the end brackets includes an aperture sized to receive the shaft, thereby permitting the end brackets to rotate about the axis of the shaft.

20. The cutting drum of claim 14, wherein the drive system first portion includes a first drive gear and wherein the drive system second portion includes a second drive gear, a first driven gear connected to the shaft and engaging the first drive gear and a second driven gear connected to the second cutting blade and engaging the second drive gear.

21. The cutting drum of claim 20, wherein the drive shaft is axially moveable and further wherein the first drive gear and the first driven gear are helical gears, so that upon axial movement of the drive shaft the position of the first drive gear relative to the second drive gear is changed.

22. The cutting drum of claim 21, wherein the drive shaft is axially moveable and further wherein the first drive and driven gears are helical gears, and the second drive and driven gears are helical gears pitched oppositely than the first drive and driven gears, so that upon axial movement of the drive shaft the first and second cutting blades are moved in opposite peripheral directions.

23. The cutting drum of claim 15, wherein each of the carrier bars includes an arcuate outer surface.

24. The cutting bar of claim 14, wherein the drive system includes a clutch assembly.

25. The cutting bar of claim 20, wherein the drive shaft includes a drive hub, and the first drive gear is attached to the drive hub by a clutch.

26. The cutting bar of claim 20, wherein the drive shaft includes a drive hub, and the first driven gear is adjustably mounted to the drive hub.

27. The cutting bar of claim 20, wherein the drive shaft includes a drive hub, and backlash adjustment means for adjustably mounting the first driven gear to the drive hub.

28. An adjustable cutting drum for use with a rotary press folding machine, comprising:

a unitary shaft having an axis and being rotatably supported on a frame the shaft including a cylindrical outer surface;

a first cutting blade secured to the shaft for common rotation therewith;

a second cutting blade;

mounting means for rotatably mounting the second cutting blade to the shaft, the mounting means exclusively engaging the shaft outer surface, the mounting means further for mounting the second cutting blade to the shaft independently of the first cutting blade to thereby permit adjustment of the second cutting blade about the axis of the rotatable shaft and along a circumferential path, thereby permitting adjustment of the relative circumferential positions of the cutting blades; and adjustable drive means operatively connected to the first and second cutting blades for rotating the first and second cutting blades at a common peripheral speed, the adjustable drive means including an axially moveable drive shaft, the drive means being adapted so that the circumferential position of the second cutting blade about the axis of the shaft and relative to the first cutting blade is adjustable in response to axial movement of the drive shaft.

29. A cutting drum having a pair of circumferentially adjustable cutting blades for use on a rotary press folding machine, comprising:

a rotatable shaft supported on a frame, the shaft comprising a one-piece shaft spanning a width of the frame, the shaft including an axis;

a first cutting blade having a pair of end brackets, the end brackets mounted to and encircling the shaft for common rotation therewith;

a second cutting blade rotatably mounted to the shaft independently of the first cutting blade by a pair of end brackets, each of the end brackets including an aperture sized to encircle an outer surface of the shaft to thereby allow the brackets to rotate relative to the shaft, so that the circumferential position of the second cutting blade about the axis of the shaft and relative to the first cutting blade may be changed; and a drive system operatively connected to the first and second cutting blades for rotating the first and second cutting blades at a common peripheral speed, the drive system further including an axially shiftable drive shaft, the circumferential position of the second cutting blade relative to the first cutting blade being adjustable in response to axial movement of the shiftable drive shaft.

30. An adjustable cutting bar assembly for mounting on a frame of a rotary press folding machine, comprising:

a continuous one-piece rotatable shaft having a longitudinal axis and defining an outer circumferential surface;

a first cutting blade assembly, the first cutting blade assembly including a pair of brackets and an interconnecting first carrier bar, the first carrier bar being adapted to support a first cutting blade, the brackets of the first cutting blade assembly being fixedly mounted about the outer circumferential surface of the shaft;

a second cutting blade assembly, the second cutting blade assembly including a pair of brackets and an interconnecting second carrier bar, the second carrier bar being adapted to support a second cutting blade, the brackets of the second cutting blade assembly being rotatably mounted about the outer circumferential surface of the shaft so that the second carrier bar is moveable about the shaft axis relative to the first carrier bar along a circumferential path, thereby permitting the second carrier bar to be placed in a plurality of positions along the circumferential path relative to the first carrier bar;

an adjustable drive system operatively engaging the shaft and the second cutting blade assembly for rotating the first and second cutting blade assemblies about the shaft axis at a common peripheral speed, at least a portion of the drive system being shiftable, the position of the second carrier bar relative to the first carrier bar being adjustable in response to shifting of the drive system portion.

* * * * *